United States Patent [19]

Roeder

[11] 4,080,111

[45] Mar. 21, 1978

[54] HIGH VOLUME, DOUBLE ACTING DOWNHOLE PUMP

[76] Inventor: George K. Roeder, Box 4335, Odessa, Tex. 79760

[21] Appl. No.: 632,550

[22] Filed: Nov. 17, 1975

[51] Int. Cl.[2] ..... F04B 17/00; F04B 35/00

[52] U.S. Cl. ..... 417/393; 417/396

[58] Field of Search ..... 417/377, 393, 522, 523, 417/396

[56] References Cited

U.S. PATENT DOCUMENTS

| | | | |
|---|---|---|---|
| 1,880,321 | 10/1932 | Jackson | 417/377 |
| 2,307,566 | 1/1943 | Browne | 417/393 |
| 2,503,986 | 4/1950 | Alley | 417/393 |
| 2,951,445 | 9/1960 | Calvert | 417/339 |
| 2,966,119 | 12/1960 | Boydston | 417/522 |
| 3,084,630 | 4/1963 | Massey | 417/523 |

FOREIGN PATENT DOCUMENTS

| | | | |
|---|---|---|---|
| 496,448 | 11/1948 | Canada | 417/392 |

*Primary Examiner*—William L. Freeh
*Attorney, Agent, or Firm*—Marcus L. Bates

[57] ABSTRACT

A downhole, hydraulically actuated, double acting pump of either the fixed or the free type, having a control valve positioned above the engine. The engine has a power cylinder chamber arranged at each extremity thereof, so that the connecting rod is placed in compression on each stroke of the engine.

The downhole pump includes spaced, external seals which form spaced, concentric, annular flow chambers therebetween, which cooperate with the various flow paths formed within the pump to enable a maximum size piston to be utilized within the apparatus. Hence, the power fluid and production fluid flow along unique flow paths, which are not formed within the side wall of the pump housing; and therefore, the apparatus accommodates a maximum diameter piston.

15 Claims, 9 Drawing Figures

HIGH VOLUME, DOUBLE ACTING DOWNHOLE PUMP

RELATED ART

U.S. Pat. Nos. 3,453,963; 3,517,741; 3,625,288; 3,627,048; 3,650,640; 3,703,926; 3,865,516; and to the art cited therein.

BACKGROUND OF THE INVENTION

Pumps of both the fixed and free type often include a control valve means axially positioned above an engine and a production pump means, and it is not unusual for the engine chambers to be positioned at each extremity of the pump means, as evidenced by my previously issued U.S. Pat. No. 3,650,640. However, in this particular fixed-type pump, provisions must be made within the side wall of the pump housing for various fluid flow paths, as for example, from the valve means to the engine means, and consequently, the diameter of the pistons thereof are reduced a corresponding amount.

Some oil wells are extremely deep and small in diameter and require a slim pump for accommodation within the slim borehole. Some of these wells are high volume producers and require a high volume pump. Accordingly, the present invention provides an improvement over U.S. Pat. No. 3,650,640 by the provision of a free-type pump which eliminates the heretofore necessary internal flow passageways formed within the side wall of the pump and engine housing. This improvement is brought about by a novel combination of flow passageways formed externally of the pump housing and other passageways formed within the reciprocating centrally located control rod of the pump assembly.

SUMMARY OF THE INVENTION

This invention relates to a free type, hydraulically actuated, downhole pump apparatus for producing a well. The pump includes spaced piston chambers which underlie a valve assembly, and a piston is reciprocatingly received within each piston chamber. The upper side of the uppermost piston and the lower side of the lowermost piston form the engine, while some of the remaining sides of the pistons form at least two production chambers. Spaced, external seals formed on the pump housing cooperate with the production tubing to provide concentrically arranged, spaced, annular passageways through which power fluid, spent power fluid, produced fluid, and production fluid can flow.

A power fluid flow path is established from the packer nose of the pump, into one of the annular passageways, and to the valve assembly. A hollow connecting rod connects each of the pistons together, forms a control rod at the upper marginal end thereof, and a passage tube at the lower marginal end thereof. The control rod extends through and cooperates with the control valve assembly in the usual manner, but terminates in a reciprocating manner within a power fluid chamber. The control valve means conducts power fluid into the power fluid chamber and conducts spent power fluid therefrom.

Power fluid flows directly from the control valve assembly, through a passageway, and into the uppermost piston chamber for downstroking the pump assembly. Power fluid to and from the lowermost engine cylinder, however, flows through the entire pump, valve, and engine assembly. More specifically, the power fluid flow path to the lowermost engine chamber is formed by means of the hollow control rod and the hollow connecting rod, so that fluid can be conducted down to and through the lowermost piston, thereby providing a source of power fluid for upstroking the lower engine piston and a means by which spent power fluid can be exhausted.

The remaining sides of the pistons form at least two production pump pistons. The suction of each production pump cylinder is connected to one of the before mentioned annulus, and the annulus is connected to the pump inlet. The uppermost production cylinder exhausts into still another annulus, which in turn is ported into the borehole annulus, while the lower production cylinder is connected to still another annulus by means of a passageway which extends through the lowermost piston, through the passage tube, and into the last named annulus, where it is then ported into the borehole annulus. Accordingly, the various embodiments of the present invention provide a free-type, double acting pump, having pistons which place the connecting rod in compression as the pump upstrokes and downstrokes.

In one embodiment of the invention, a traveling valve means is provided within the production passageway leading through the lowermost piston, so that a single pair of pistons provides a double acting engine and a double acting pump.

In another embodiment of the invention, three pistons are employed, with the uppermost piston having the underside thereof always exposed to the hydrostatic head of the produced fluid to thereby enhance the upstroke cycle, while the centrally located piston has the upper side thereof arranged to move production fluid. The lower side of the central or second piston ingests a supply of production fluid on the upstroke and transfers the production fluid into the upper chamber of the lowermost piston chamber, so that the lowermost piston also moves fluid only on the upstroke. Hence, the double acting engine powers a pump having spaced pistons which form spaced production cylinders, and which forces fluid to the surface of the ground on both the upstroke and the downstroke.

Accordingly, a primary object of this invention is the provision of a downhole, hydraulically actuated pump which has a maximum diameter engine and pump piston for a particular size pump housing.

Another object of the invention is to provide a deep well pump assembly having external seals which form flow paths for the various fluids flowing to and from the pump assembly.

A further object of the invention is to disclose and provide a free-type pump assembly which produces fluid in a manner which places the connecting rod in compression on the upstroke and downstroke.

A still further object of this invention is to provide a free-type pump having a double acting engine and a double acting production pump with the pistons thereof being of a maximum diameter respective to the pump and engine housing.

Another and still further object of this invention is the provision of a slim, high, production downhole pump assembly of the free type which employs an axial flow passageway in conjunction with a plurality of external concentric flow passageways to provide a maximum diameter piston for the engine and production pump.

These and various other objects and advantages of the invention will become readily apparent to those skilled in the art upon reading the following detailed description and claims and by referring to the accompanying drawings.

The above objects are attained in accordance with the present invention by the provision of a combination of elements which are fabricated in a manner substantially as described in the above abstract and summary.

DETAILED DESCRIPTION OF THE PREFERRED EMBODIMENT

Figure 1:
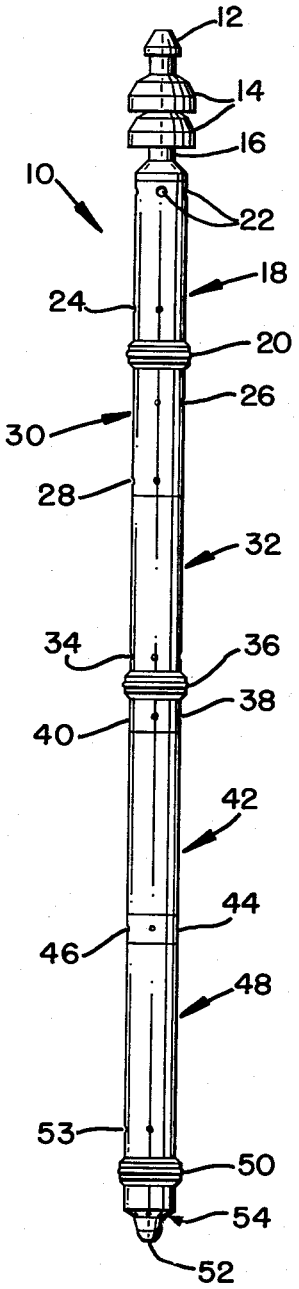
FIG. 1 is a side elevational view of a downhole pump assembly made in accordance with the present invention.

In FIG. 1 there is disclosed a downhole, hydraulically actuated pump assembly 10 made in accordance with the present invention. The upper extremity of the pump is provided with a fishing neck 12, which is hollow, and which provides a power fluid inlet thereinto. Spaced resilient packers 14 sealingly engage the interior marginal side wall of a production tubing, and permit the pump to be pumped into and out of a borehole. The packer nose assembly continues at 16 in the form of a hollow mandrel, and downwardly diverges into an upper marginal portion 18. The exterior of the pump is disclosed herein as being of a constant diameter; however, it can be of various different diameters as may be required for employment of various different design expedients.

Upper seal means 20 underlies a power fluid outlet port 22 and a power fluid inlet port 24. Spent power fluid exhausts from ports 26 and 28, each of which are located within a marginal portion 30 of the main housing. The control valve assembly is located within section 30 of the housing, and the details thereof will be more fully discussed later on in this disclosure.

The main housing continues at 32 where it forms an uppermost piston cylinder. Ports 34 are positioned above seal 36 and enables fluid to flow into and out of the interior of the housing. Port 38 underlies seal 36 and permits fluid to flow into assembly 40 which contains a set of production valves.

A centrally located piston cylinder is housed at 42, while sub assembly 44 contains a production inlet port 46 and houses a set of production valves therewithin. A lowermost piston cylinder 48 is positioned above a seal means 50 and includes a production outlet port 53. A seating sub assembly underlies seal 50 and contains a production inlet port 52 and a production outlet port 54.

Figure 2:
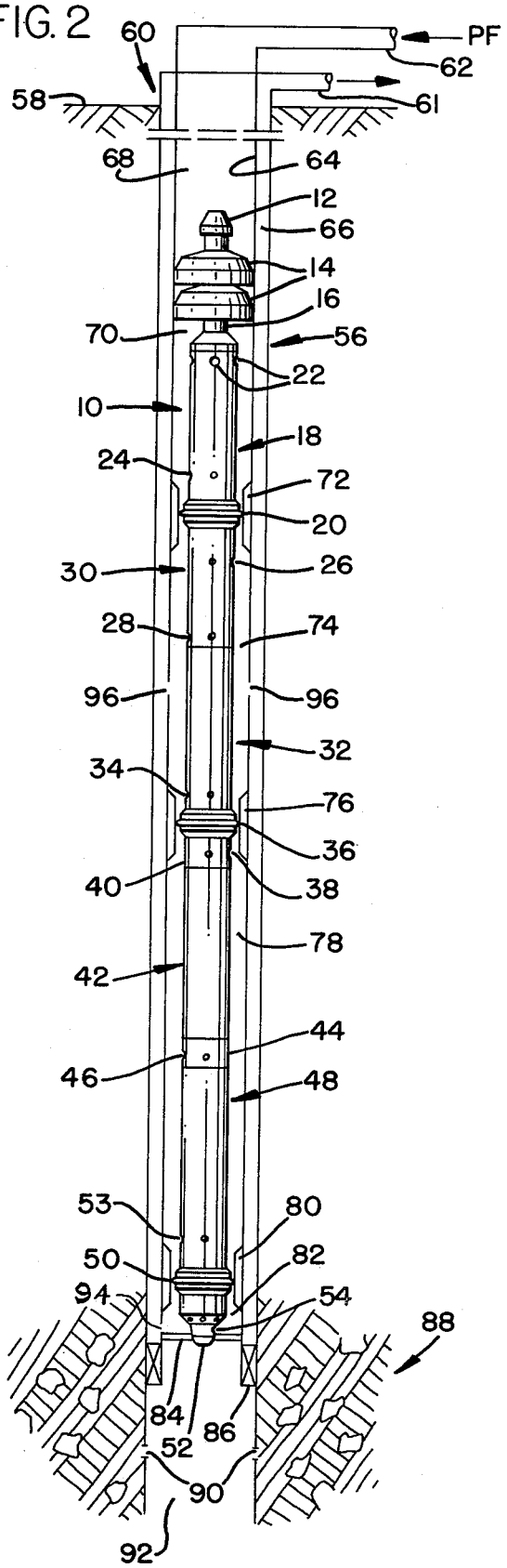
FIG. 2 is a part cross-sectional, part diagrammatical representation of a downhole pump assembly, made in accordance with the present invention, and disclosed downhole in a deep borehole.

As best seen schematically illustrated in FIG. 2 in conjunction with other figures of the drawings, the pump of the present invention is illustrated in one of its operative configurations respective to a power string and a cased borehole. The borehole 56 extends below the ground level 58 and includes the usual wellhead assembly schematically illustrated by numeral 60. Numeral 62 indicates a power fluid tubing inlet, similar to a production tubing, so that power fluid can flow down the power tubing string at 64. Borehole or casing annulus 66 is formed between the tubing and the casing. Hence, power fluid can flow down through the interior of the tubing string and to the packer nose assembly of the free-type, hydraulically actuated pump.

Annulus 70 is formed between the packers 14 and the uppermost seal 20 and 72, and provides an isolated flow path whereby power fluid received from outlets 22 can flow into the inlets 24. Reduced diameter, circumferentially extending, marginal interior portions 72, 76, and 80 cooperate with the before mentioned seal means 20, 36, and 50 to provide concentrically arranged, axially spaced, annular chambers 74 and 78. Annulus 82 is formed between the lowermost seal 50, 80 and a seating shoe 84, the details of which are more fully explained in my before mentioned U.S. Pat. No. 3,865,516.

Downhole packer and anchor device 86 is located in proximity of a production formation and above the casing perforations 90. The perforations admit the flow of hydrocarbons from the hydrocarbon producing zone into the lower extremity 92 of the borehole in the usual manner.

Ports 94 and 96 are formed within the lower tubing string for communicating annulus 82 and 74 with the borehole annulus, and forms a means by which produced and spent power fluid can flow uphole to the wellhead.

Looking now to the details of FIGS. 3–7, in conjunction with the foregoing figures, it is seen that the lower extremity of the pump is provided with a production inlet 97, which is connected to an outlet port 53 by means of an internal passageway 98 formed below the pump housing.

Hollow control rod 100 has a power fluid inlet 102 formed therewithin. The upper marginal end of the rod reciprocates within a power fluid inlet chamber 103.

Underlying and immediately adjacent to the illustrated control valve assembly there is illustrated an uppermost piston cylinder comprised of an upper cylinder chamber 104, a lower cylinder chamber 105, and an uppermost piston 106. The piston is connected to a hollow connecting rod 108, which extends down through the before mentioned production valve assembly, and into the intermediate piston cylinder. The last said cylinder is comprised of upper and lower intermediate piston chambers 110 and 111, which are formed by and reciprocatingly receive the intermediate piston 112.

A lowermost piston cylinder is similarly comprised of an upper and lower piston chamber 114, 115, respectively, within which a lowermost piston 116 reciprocates.

The hollow passageway 118 of the connecting rod terminates as a power fluid outlet 120 within the before mentioned lowermost piston and provides the lower chamber of the lowermost piston cylinder with a means by which power fluid and spent power fluid can flow to and from the control valve.

Inlet 122 connects piston passageway 123 with the interior of a hollow passage tube 124. The passage tube has an outlet 126, and the lower marginal end thereof reciprocates within a production fluid cavity 128. The cavity is connected to the lowermost annulus 82 by means of the outlet port 54.

In operation of the above described embodiment, the pump is circulated downhole in the usual manner until the inlet end 52 thereof sealingly engages the combination valve and seat assembly 87. At the same time, seals 20, 36, and 50 of the housing sealingly engage the reduced diameter portion 72, 76, and 80 of the tubing, while the packer nose assembly sealingly engages the interior of the power tubing. This novel arrangement forms spaced, concentrically arranged annulus 70, 74, 78, and 82, with the interior of the upper power tubing 68 being isolated therefrom. Formation fluid is free to flow from the production formation, through the casing perforations, and into the lower portion 92 of the borehole where the fluid can continue to flow through the foot valve and into the production inlet 97 of the pump. From passageway 98, fluid flows into the second lowermost annulus, where the fluid is then free to flow into the production inlets 46 and 38.

Fluid flowing through the production or suction port 38 is pumped by the upper surface of piston 112 through the check valve means 35, through the production outlet 34, into the annulus 74, through the ports 96 of the tubing, into the borehole annulus, and uphole to the surface of the ground where the production fluid can be connected to a tank battery by means of outflow piping 61.

At the same time, production fluid is free to enter the lower chamber 111 by means of the production inlet or suction port 46. Piston 112 transfers the production fluid from chamber 111 into chamber 114 by means of the check valve arrangement found in passageway 45. Each upstroke of the engine sucks fluid into chamber 111, while the noncompressible fluid in chamber 114 is forced to flow into the piston port 122, through the piston passageway 123, through the hollow passage tube 124, through the outlet 126, into the production cavity 128, through the production outlet 54, and into the lowermost annulus 82, where the fluid continues to flow on through ports 94 and into the borehole annulus, where it joins the previously mentioned produced fluid.

It should be noted that piston 112 must cause fluid to be ingested into chamber 111 and subsequently transferred into chamber 114, while piston 116 forces fluid contained within chamber 114 to the surface of the ground, with this action occurring on the upstroke.

It should furthermore be noted that production fluid from annulus 74 enters both the lower chamber 105 and the upper chamber 110 by means of production inlet ports 34. The fluid within chamber 105 is subject to the entire hydrostatic head of the produced fluid, since annulus 74 is connected to the borehole annulus by means of port 96. Consequently, during the upstroke, the entire hydrostatic head is effected against the lower face of piston 106 so that the hydrostatic head is available to augment the upstroke action of the engine. On the downstroke, piston 106 must lift the entire fluid column in an amount equivalent to the displacement of fluid from the chamber 105. On the upstroke, the fluid weights in chambers 104 and 105 are approximately equal.

Looking now to the details of the engine section of the pump, power fluid flows into the packer nose, out of ports 22, and into the uppermost annulus 70. Power fluid enters port 24 where it is available to the control valve. As the connecting rod reciprocates, the control rod causes the valve to alternately shift. This action alternately connects power chambers 104 and 115 to a source of power fluid and to the power fluid exhaust. Flow to the upper engine piston chamber is accomplished by passageway 99, through which power fluid and spent power fluid flows to and from chamber 103. From chamber 103, fluid flows along the interior of the power rod, through the various pistons and cylinder chambers, and into lower piston chamber 115, where it upstrokes the engine. On the downstroke, spent power fluid reverses this direction of travel.

The upper engine piston chamber 104 is connected to the control valve by means of the power fluid flow passageway 105. During the upstroke, power fluid exhausts at 26 and comingles with the produced fluid within the annulus 74. At the same time, power fluid enters chamber 103 from annulus 70 by means of port 24.

Figure 8:
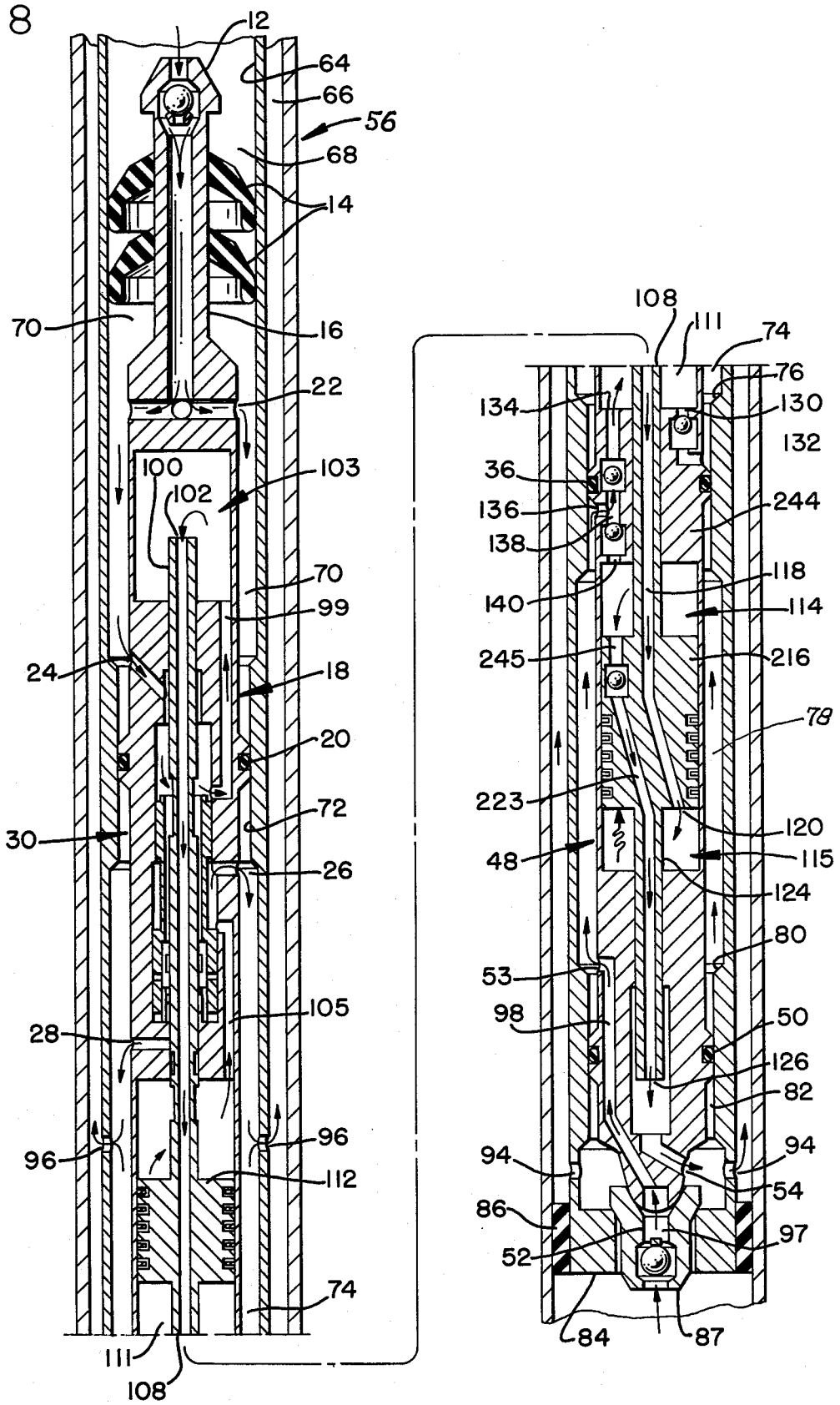
FIG. 8 is a longitudinal, cross-sectional view of a second embodiment of the present invention; and, FIG. 9 is a longitudinal, cross-sectional view of still another embodiment of the invention.

In the embodiment disclosed in FIG. 8, the pistons are limited in number to two, that is, pistons 112 and 216. Piston 216 is provided with the before mentioned piston port 120 which is connected to the before mentioned passageway 118 formed in the hollow connecting rod. Produced fluid must therefore flow from production inlet chamber 114 and through the passageway 223 formed within the piston by means of the illustrated check valve which is seen positioned within passageway 245.

Production valve assembly 244 is provided with a passageway 130, which connects chamber 111 to annulus 74 by means of an outlet port 132. The illustrated ball check valve assembly located within passageway 130 prevents the reverse flow of fluid into chamber 111. Port 134 provides chamber 111 with a source of production fluid. Passageway 138 provides chamber 114 with a source of production fluid by means of the production port 140. The illustrated ball check valves associated with passageway 138 prevents flow of fluid from chamber 111 or 114 back towards the suction inlet port 136.

As the piston 216 downstrokes, formation fluid flows from passageway 98, into annulus 78, into port 136, where the fluid can then flow through the valve and into chamber 114. As the piston upstrokes, fluid flow through port 140 is precluded by the ball check valve. Accordingly, fluid must flow through the passageway 245, through the ball check valve located within the piston production passageway 223, out passage tube 124, and into the production cavity. During the upstroke, fluid flows into port 136, across the ball check valve located in passageway 134, and into chamber 111.

Hence, the embodiment of FIG. 8 provides both a double acting engine and a double acting pump, which is arranged to provide pump and engine pistons of a maximum diameter, and which places the connecting rod in compression each time the pump is stroked. The smaller production pistons employed in the downhole pump varies the power ratio available.

The term "pump housing" includes the structure which commences at the upper cylinder portion at numeral 132, and terminates at the lower cylinder portion at numeral 148. There are no flow passageways formed within the pump housing when the housing is defined within these limits.

Figure 9:
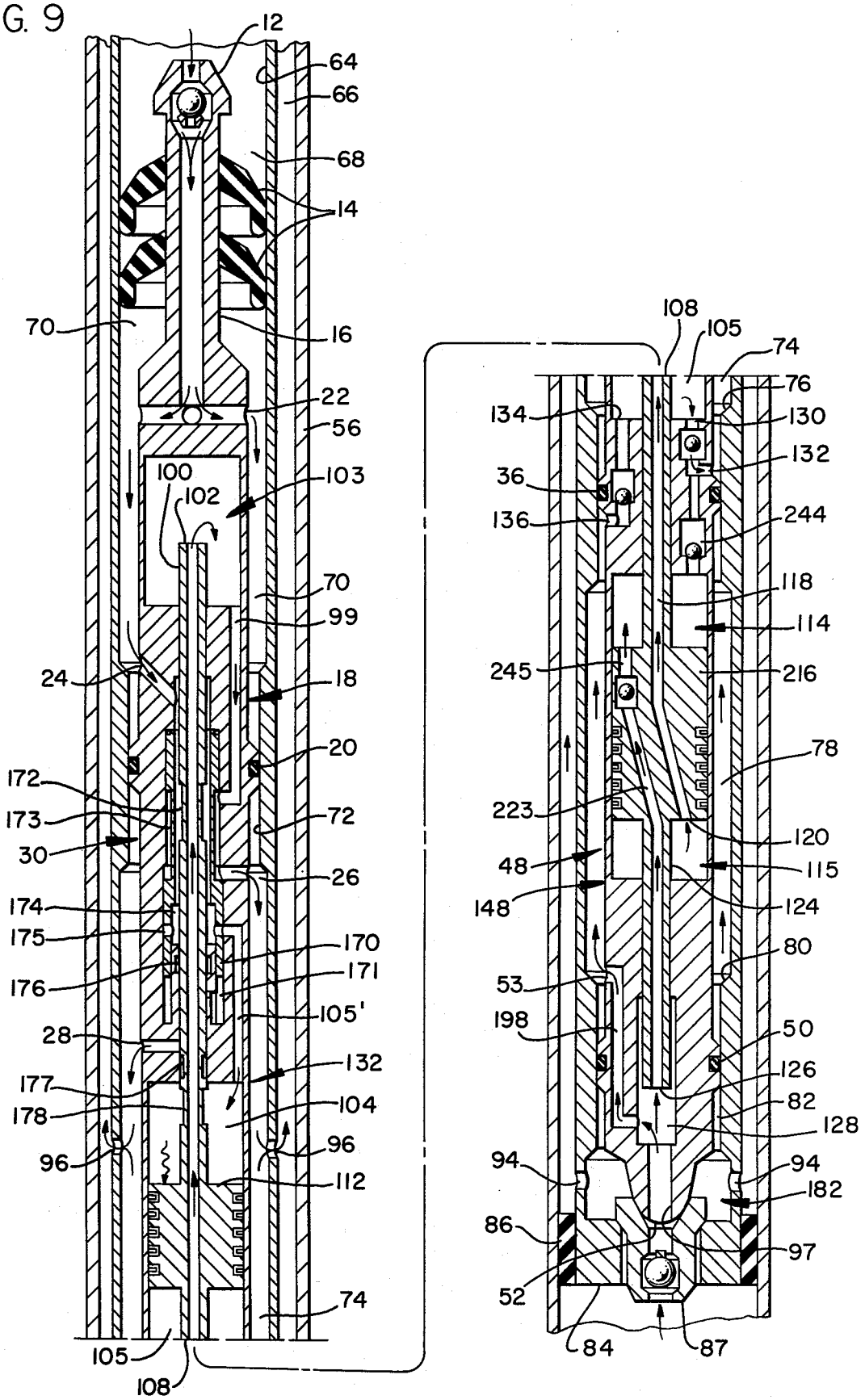

In the embodiment disclosed in FIG. 9, formation fluid flows into the standing valve 87, into the inlet end 52 of the pump, and through the inlet passageway 97 where the fluid is then free to flow into an inlet cavity 128. The inlet cavity 128 reciprocatingly receives the marginal end of the passage tube, and also provides a source of formation fluid for each production cylinder of the pump by means of two separate but parallel flow paths.

One of the parallel flow paths comprises a passageway 198, outlet port 53, annulus 78, and an inlet 136. The formation fluid flows from the inlet 136, through the valve located within passageway 134, and into production chamber 111. Produced fluid is forced from production chamber 111, through port 130, out of port 132, and into the annulus 74.

The other of the parallel flow paths comprises the inlet end 126 of the hollow passage tube 124, piston passageway 223, across the valve located within piston passageway 245, and into the production chamber 114. Produced fluid from the lower production chamber 114 is forced to flow across the valve located within passageway 224, where the produced fluid joins the produced fluid from the other parallel flow path at outlet 132, and flows into annulus 74.

Hence, formation fluid flows into the common inlet cavity 128, where the fluid flow diverges into two parallel flow paths, with one flow path being located externally of the pump housing, and the remaining flow path being conducted along the axial center line of the pump assembly. The formation fluid follows the parallel flow paths and ultimately moves to a common pump outlet, where the joined together, parallel paths flow into an external annulus which forms a production flow path. The comingled produced fluid exits at ports 96 into the casing annulus.

The ports 94 enable reverse flow of fluid effected at the well head to enter annulus 182 for the purpose of lifting the pump assembly from its seated position, so that the entire pump assembly can be flowed uphole to the well head when it is deemed desirable to retrieve the downhole pump assembly.

Where considered advantageous, the packer nose assembly may be modified wherein the power fluid tubing is connected directly to the mandrel, with suitable flow connections being effected between the interior of the power tubing and the control valve inlet 24. This modification provides a fixed-type pump assembly which incorporates the present invention therein.

The valve assembly of the present invention preferably is made in accordance with either of my previously issued U.S. Pat. Nos. 3,915,595, 3,957,400, or 3,865,516. Reference is made to these prior patents for the details of construction and operation of the instant valve assembly.

Figure 3:
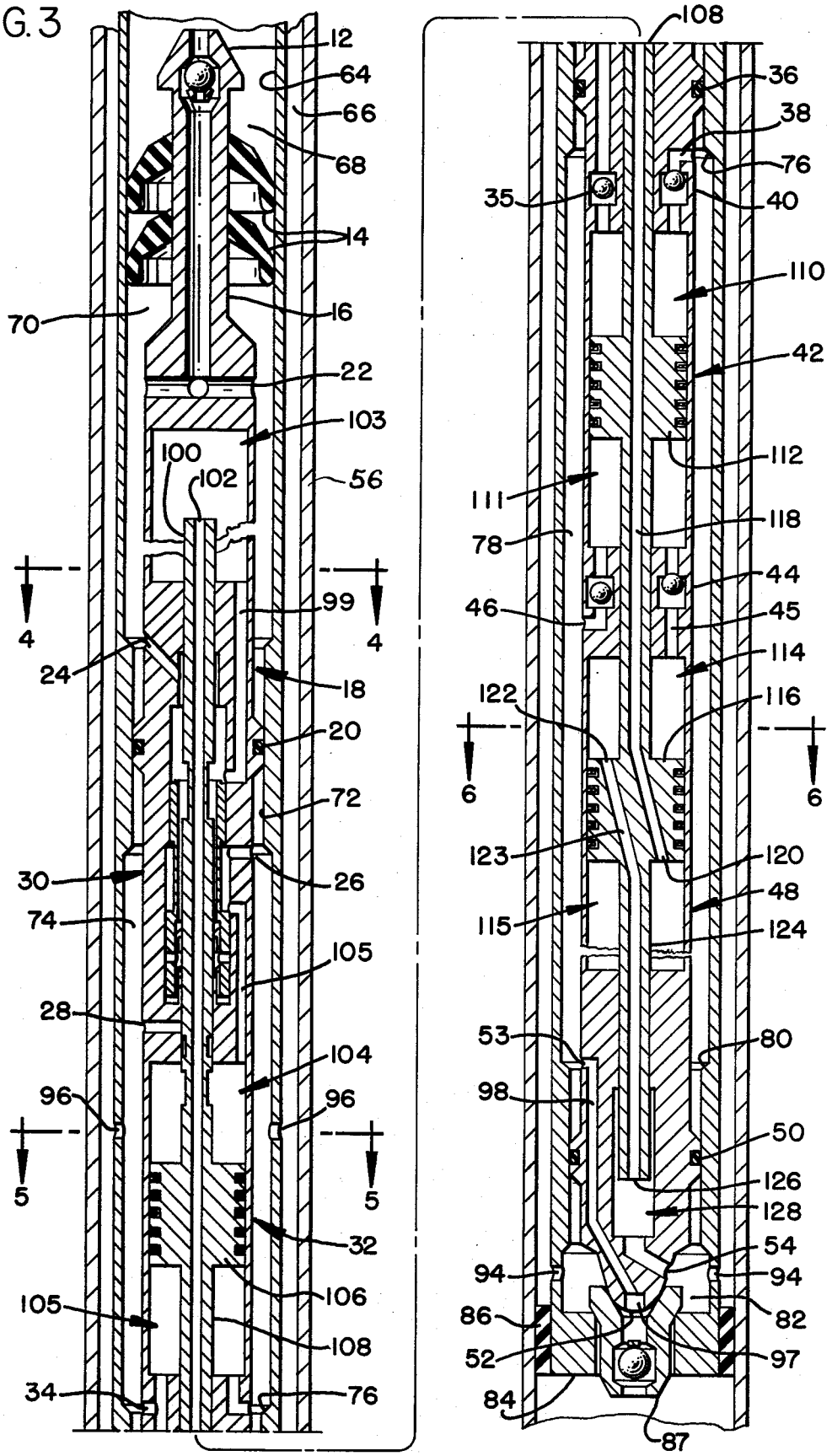
FIG. 3 is an enlarged, detailed, longitudinal cross-sectional view of the downhole pump assembly seen in FIGS. 1 and 2.
Figure 4:
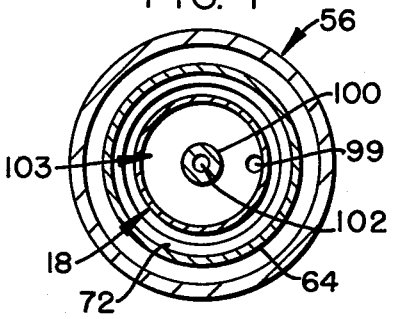
FIGS. 4, 5, and 6, respectively, are cross-sectional views taken along lines 4—4, 5—5, and 6—6, respectively, of FIG. 3.
Figure 5:
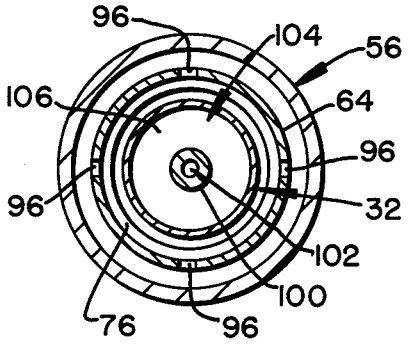
Figure 6:
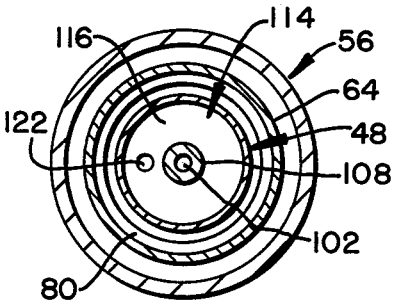
Figure 7:
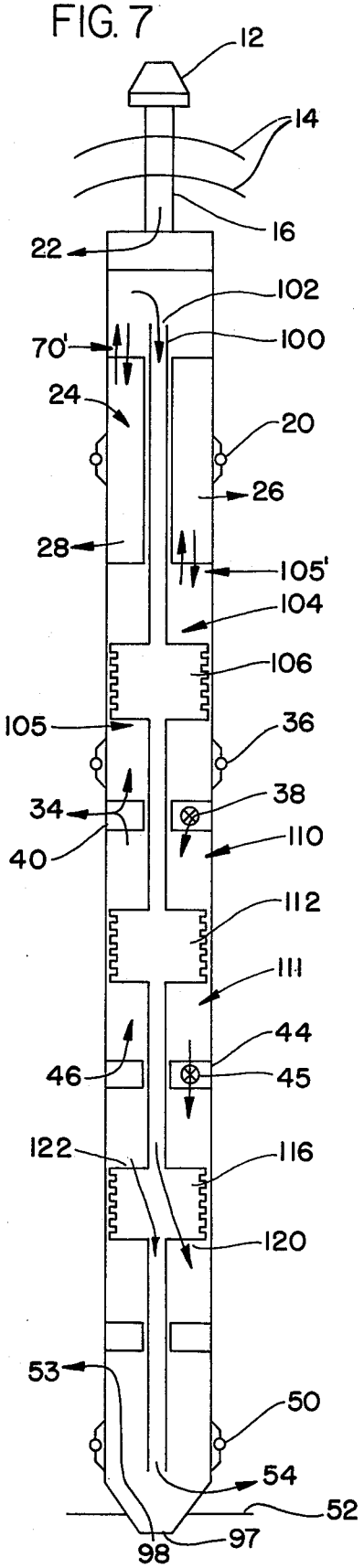
FIG. 7 is a part diagrammatical, part schematical representation of the pump seen in the foregoing figures which discloses the essence of the present invention.

The sliding valve element is shown in its lowermost position in FIG. 3 and is disclosed in its uppermost position in FIG. 9. The valve element 170 is shifted from the lower to the upper position as the control rod strokes to its lowest position. As the control rod strokes downwardly, the undercut area 172 causes fluid to flow under the valve element by interconnecting the annulus 171 and 174. The pressure difference across the valve and the difference in area thereof causes the valve element to stroke upwardly, thereby allowing power fluid to flow into the uppermost engine cylinder at 105' while spent power fluid is exhausted from the lowermost engine cylinder by means of the hollow rod at 118, chamber 103, passageway 99, and the port seen located near numeral 26.

As the rod strokes upwardly, the undercut areas 177, 178 cause fluid to be exhausted from chamber 171 through port 28, thereby causing the valve element to shift into its lowermost position, whereupon the valve assumes the configuration seen in FIGS. 3 and 8. Power fluid now is supplied to passageway 99, chamber 103, and thence to the lower engine chamber while spent power fluid is exhausted from the upper piston chamber along passageway 105' and port 26.

I claim:

1. A downhole hydraulically actuated pump assembly for producing a well comprising an elongated pump housing having an upper and a lower end; spaced piston cylinders formed within said housing in axial alignment with one another;

a piston reciprocatingly received within each said piston cylinder, each said piston dividing its corresponding piston cylinder into an upper and lower piston chamber;

means forming a control valve assembly at the upper marginal end of said pump assembly, means forming a production inlet at the lower end of said pump assembly; means forming a power fluid inlet passageway at the upper end of said pump assembly, means forming a power fluid chamber between said power fluid inlet and said valve assembly, means forming a production fluid cavity between said production inlet and the lowermost piston chamber;

a hollow control rod extending from said power fluid chamber, through said control valve means, and to the uppermost of said pistons, a hollow connecting rod interconnecting each of said pistons, a hollow passage tube extending from the lowermost of said pistons and into said production fluid cavity;

the uppermost of said upper piston chambers and the lowermost of said lower piston chambers being engine chambers, there being at least two remaining piston chambers which are production chambers;

means forming a flow path from said power fluid inlet to said control valve assembly, means forming a power fluid flow path from said control valve assembly and a spent power fluid flow path to said control valve assembly; means forming a flow path to said uppermost of said upper piston chambers and to said lowermost of said lower piston chambers; means, including said valve assembly, by which said flow path to said uppermost and lowermost piston chambers are alternately connected to said power fluid flow path and said spent power fluid flow path;

said flow path to said lowermost piston chamber includes means forming a flow passageway from said valve assembly to said power fluid chamber, through said hollow control rod, through said hollow connecting rod and the pistons connected thereto, and through the lowermost of said lower pistons to thereby enable the lowermost piston to upstroke the pump apparatus;

means forming a produced fluid outlet for each of said production chambers; the last said means including a produced fluid flow path which extends from said upper piston chamber of said lower piston cylinder, through said lowermost piston, through said hollow passage tube, and into said production fluid cavity;

means, including a check valve, forming a flow path from said production inlet into each of said production chambers.

2. The pump assembly of claim 1 wherein there is included three of said spaced piston cylinders, a flow port is formed in said housing which directly connects the lower chamber of one of said piston chambers to a source of produced fluid so that any hydrostatic head of the produced fluid is always effected upon the lowermost side of the last said piston.

3. The pump of claim 1 wherein said pump assembly is a free-type pump which includes a plurality of spaced seal means arranged thereon to provide a plurality of spaced annular flow passageways when the pump is seated downhole in a tubing string; the uppermost of said annular passageways connecting said power fluid inlet to a source of power fluid, the adjacent annular passageway connecting the uppermost production fluid outlet to the casing annulus, the lowermost of said annular passageways connecting the outlet cavity to the casing annulus, and the next adjacent annular passageway connecting one of said production chambers to a source of formation fluid.

4. The pump of claim 1 wherein the number of pistons is limited to three, means forming a flow passageway from the produced fluid outlet to the lower chamber of said uppermost piston cylinder such that the last said chamber always is subjected to the hydrostatic head of any fluid produced by the pump;

means, including a check valve, connecting the upper piston chamber of said lowermost piston cylinder to the lower piston chamber of the intermediate piston cylinder; means, including a check valve, connecting the last said lower chamber to said production inlet.

5. The pump of claim 4 wherein an outlet port is formed in said housing and directly connects said lower chamber of said uppermost piston chamber to a source of produced fluid so that any hydrostatic head of the produced fluid is always effected upon the uppermost of said pistons.

6. The pump of claim 1 wherein an outlet port is formed in said housing and directly connects said lower chamber of said uppermost piston chamber to a source of produced fluid so that any hydrostatic head of the produced fluid is always effected upon the uppermost of said pistons.

7. The pump of claim 1 wherein said piston cylinders are limited to two;

means, including a check valve arrangement, by which the upper chamber of said lowermost piston cylinder is connected to cause fluid to be forced from said production inlet to said produced fluid outlet as said lowermost piston reciprocates;

and means, including a check valve, by which production fluid is forced to flow from said production inlet, into said lower chamber of said upper piston cylinder, and to said produced fluid outlet as said connecting rod strokes the pump.

8. The pump of claim 7 wherein said check valve arrangement includes a check valve mounted within said lowermost piston which enables produced fluid to flow from the upper chamber of said lower piston cylinder, through the last said piston, and into said hollow passage tube.

9. The pump assembly of claim 1 and further including a production tubing within which said pump is operatively positioned, spaced seal means forming first, second, third, and fourth annulus between the exterior of said pump apparatus and the interior of said production tubing;

outlet ports formed in said tubing at a location which permits produced fluid to flow from said first and third annulus, through said tubing, and into a borehole annulus when the pump and production tubing is operatively positioned within a wellbore;

said production fluid outlet chamber being connected to said first annulus;

said means forming a flow path from said power fluid inlet to said control valve means includes said fourth annulus;

said spent power fluid flow path and one of said produced fluid flow paths includes said third annulus; and, said means forming a flow path from said production inlet into said production chamber includes said second annulus.

10. The pump assembly of claim 9 wherein an outlet port is formed in said housing and directly connects said lower chamber of said uppermost piston cylinder to a source of produced fluid so that any hydrostatic head of the produced fluid is always effected upon the uppermost of said pistons.

11. In a double acting, downhole, hydraulically actuated pump assembly of the free type which can be circulated downhole through a tubing string into seated position respective to a seating shoe, and which includes a control valve means associated therewith for causing a pair of engine pistons to reciprocatingly actuate a production pump to produce fluid which flows from a formation and uphole through the borehole annulus, the improvement comprising:

said engine pistons being spaced from one another and reciprocatingly received within a cylinder, means by which each of said pistons divides its corresponding cylinder into an upper and a lower chamber;

seal means dividing the annulus formed between the pump assembly and the tubing string into spaced, axially aligned annulus;

a power fluid inlet at the upper end of the pump assembly, a production inlet formed at the lower end of the pump assembly, a power fluid inlet chamber formed within the upper marginal end of the pump assembly; flow passage means, including one of said annulus, by which power fluid flows from said power fluid inlet into said power fluid inlet chamber;

said pistons being connected together by a hollow connecting rod, the upper chamber of the uppermost cylinder being a power cylinder, said control valve being located between said power cylinder and said power fluid inlet chamber, a hollow control rod connected to the uppermost of said pistons and extending through said control valve and into said power fluid inlet chamber; and a hollow passage tube extending downwardly from the lowermost piston; a lower production cavity which reciprocatingly receives a marginal end of said passage tube;

the lower chamber of the lowermost of said cylinders being a power chamber, means forming a flow path from said power fluid inlet chamber, through said control rod, through said hollow connecting rod, through the lowermost piston, and into said lower chamber of said lowermost of said cylinders;

means forming the remaining said chambers into two spaced production chambers;

means forming a flow path which extends from one of said production chambers, through said lowermost pistons, through said production cavity, out of said pump, into one of said annulus, through a sidewall of said tubing string, and into the borehole annulus;

means forming a production fluid flow path which extends from said production inlet, into one said annulus, and into each of said two production chambers;

one of said two production chambers having a produced fluid flow passageway which extends into another of said annulus, through a sidewall of the tubing, and into the borehole annulus;

and means conducting spent power fluid from said control valve means, into the last recited annulus, where the spent power fluid comingles with some of the produced fluid.

12. The pump assembly of claim 11 wherein a flow port is formed in said housing which directly connects the lower chamber of one of said piston chambers to a source of produced fluid so that any hydrostatic head of the produced fluid is always effected upon the lowermost side of the piston associated with the last said lower chamber.

13. The pump assembly of claim 11 wherein the number of pistons is limited to three, means forming a flow passageway from the produced fluid outlet to the lower chamber of said uppermost piston cylinder such that the last said chamber always is subjected to the hydrostatic head of any fluid produced by the pump.

means, including a check valve, connecting the upper piston chamber of said lowermost piston cylinder to the lower piston chamber of an intermediate piston cylinder; means, including a check valve, connecting the last said lower chamber to said produced fluid inlet.

14. The pump assembly of claim 11 wherein said piston cylinders are limited to two;

means, including a check valve arrangement, by which the upper chamber of said lowermost piston cylinders is connected to cause fluid to be forced from said production inlet to said produced fluid outlet as said lowermost piston reciprocates;

and means, including a check valve, by which production fluid is forced to flow from said production inlet, into said lower chamber of said upper piston cylinder, and to said production outlet as said connecting rod strokes the pump.

15. The pump assembly of claim 14 wherein said check valve arrangement includes a check valve mounted within said lowermost piston which enables produced fluid to flow from the upper chamber of said lower piston cylinder, through the last said piston, and into said passage tube.

* * * * *